US008441506B2

(12) United States Patent
Lee et al.

(10) Patent No.: US 8,441,506 B2
(45) Date of Patent: May 14, 2013

(54) LIQUID CRYSTAL DISPLAY AND METHOD FOR INITIALIZING FIELD PROGRAMMABLE GATE ARRAY

(75) Inventors: Taewook Lee, Gyeonggi-do (KR); Minkyu Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 398 days.

(21) Appl. No.: 12/836,064

(22) Filed: Jul. 14, 2010

(65) Prior Publication Data

US 2011/0157241 A1 Jun. 30, 2011

(30) Foreign Application Priority Data

Dec. 28, 2009 (KR) ..... 10-2009-0131973

(51) Int. Cl.
*G09G 5/10* (2006.01)

(52) U.S. Cl.
USPC ..... 345/690; 345/89; 345/102; 345/211; 345/691; 345/99; 362/600

(58) Field of Classification Search ..... 345/89, 345/99, 211, 213, 690, 102, 691; 362/97.1–97.3, 362/600
See application file for complete search history.

(56) References Cited

U.S. PATENT DOCUMENTS

| | | | | |
|---|---|---|---|---|
| 6,342,876 | B1 * | 1/2002 | Kim | 345/87 |
| 2001/0043186 | A1 * | 11/2001 | Yoshine | 345/98 |
| 2006/0227127 | A1 * | 10/2006 | Wang et al. | 345/213 |
| 2008/0117162 | A1 * | 5/2008 | Song et al. | 345/102 |

FOREIGN PATENT DOCUMENTS

KR 1020050113723 A 12/2005

OTHER PUBLICATIONS

English translation of Korean Patent Publication "Plasma Display Device and Driving Method Thereof" Sang-Tae Kim, Publication No. 10-2005-0113723.*
Chinese Office Action and English Translation dated May 30, 2012, issued in a corresponding Chinese patent application.

* cited by examiner

*Primary Examiner* — Lun-Yi Lao
*Assistant Examiner* — MD Saiful A Siddiqui
(74) *Attorney, Agent, or Firm* — Morgan, Lewis & Bockius LLP

(57) ABSTRACT

The present disclosure relates to a liquid crystal display device including a field programmable gate array (or "FPGA") and a method for initializing the FPGA in stable. The present disclosure suggests a liquid crystal display device comprising: a liquid crystal display panel including a plurality of data lines and a plurality of gate lines crossing each other; a backlight unit configured to radiate backlight to the liquid crystal display panel; a backlight driving circuit configured to turn on and off light sources of the backlight unit according to a backlight dimming data; a data driving circuit configured to convert digital video data into positive and negative data voltages and to supply the positive and the negative data voltages to the plurality of data line; a gate driving circuit configured to supply a gate pulse to the plurality of gate line sequentially; a field programmable gate array configured to set circuit configurations of a built-in gate array logic part according to a gate array connection data downloaded from a non-volatile memory in order to modulated an input video data and to generate the backlight dimming data; and a timing controller configured to control operating timings of the data driving circuit and the gate driving circuit.

5 Claims, 7 Drawing Sheets

LIQUID CRYSTAL DISPLAY AND METHOD FOR INITIALIZING FIELD PROGRAMMABLE GATE ARRAY

This application claims the benefit of Korean Patent Application No. 10-2009-0131973 filed on Dec. 28, 2009, which is incorporated herein by reference for all purposes as if fully set forth herein.

BACKGROUND OF THE INVENTION

1. Field of the Invention

The present disclosure relates to a liquid crystal display device including a field programmable gate array (or "FPGA") and a method for initializing the FPGA.

2. Discussion of the Related Art

An active matrix type liquid crystal display device (or "AMLCD") represents video data using the thin film transistor (or "TFT") as the switching element. As the AMLCD can be made in thin flat panel with lightening weight, nowadays in the display device market, it is replacing cathode ray tube (or "CRT") and applied to portable information appliances, computer devices, office automation appliances, and/or television sets.

The AMLCD comprises a data driving circuit for supplying the data signals to the data lines of the LCD panel, a gate driving circuit for sequentially supplying the gate pulse (or scan pulse) to the gate lines of the LCD panel, and a timing controller for controlling the operating timing of the data driving circuit and the gate driving circuit.

Recently, in order to improve the video quality of the AMLCD, various algorithms are added to the timing controller for compensating or enhancing the video quality. These algorithms are typically applied as hardware methods. However, applying these algorithms with hardware type need much more manufacturing tact time and cost because more times and efforts are required to design, to pack, and to test the timing controller having newly applied algorithm.

For the application specific IC (or "ASIC"), it is impossible to re-set the setting of the ASIC after it is manufactured. Therefore, when it is required to apply new algorithms or to update the exist algorithms, the ASIC should be re-designed and re-manufactured with a lot of time for testing and cost.

The field programmable gate array, as one of the programmable logic device (or "PLD"), is the integrated circuit (or "IC") which can be reset its logical circuit configuration, at any time. The FPGA includes the programmable logic elements and the programmable connections. The FPGA may further include a phase-locked loop (or "PLL") for multiplying the frequency of the input clock.

The programmable logic elements include the logic elements such as the AND gate, the OR gate, the XOR gate, and NOT gate. By connecting these logic elements included in the FPGA, any complex circuit can be configured in the FPGA. By modifying the software for the logic connections of the logic elements, the function of the FPGA can be reset. The FPGA have been mainly used for developing various ASIC. Recently, the FPGA is applied to the mass production for the electric appliances.

The FPGA can be applied to a liquid crystal display device for sampling the data of the input video data and for compensating the pixel data according to the pre-set algorithms. In order to operate the FPGA in stable status, the FPGA should be initialized stably. When the FPGA and the built-in (embedded) PLL of the FPGA are initialized according to the power sequence of the LCD, the initialization of the PLL may be unstable, so that the FPGA may operate in the state that the output of the PLL is not locked. In that case, as the pixel data is not normally output from the FPGA, the LCD does not represents video data normally.

SUMMARY OF THE INVENTION

In order to overcome the above mentioned drawbacks, the purpose of the present disclosure is to suggest a liquid crystal display device having a field programmable gate array of which initialization is stably conducted, and a method for initializing the field programmable gate array.

In order to accomplish the above purpose, the present disclosure suggests a liquid crystal display device comprising: a liquid crystal display panel including a plurality of data lines and a plurality of gate lines crossing each other; a backlight unit configured to radiate backlight to the liquid crystal display panel; a backlight driving circuit configured to turn on and off light sources of the backlight unit according to a backlight dimming data; a data driving circuit configured to convert digital video data into positive and negative data voltages and to supply the positive and the negative data voltages to the plurality of data line; a gate driving circuit configured to supply a gate pulse to the plurality of gate line sequentially; a field programmable gate array configured to set circuit configurations of a built-in gate array logic part according to a gate array connection data downloaded from a non-volatile memory in order to modulated an input video data and to generate the backlight dimming data; and a timing controller configured to control operating timings of the data driving circuit and the gate driving circuit.

A method for initializing the FPGA of the liquid crystal display device comprising supplying a gate array connection data stored in a non-volatile memory to the FPGA during from when a logic power voltage generated after a power of the liquid crystal display device is turn on is converted into a high logic voltage to when a configuration signal is reversed to the high logic voltage; configuring a circuit in a gate array logic part of the FPGA according to the gate array connection data; generating a FPGA reset signal after the configuration signal is reversed to the high logic voltage; locking a frequency and a phase of an internal clock output from the PLL of the FPGA using the FPGA reset signal; and modulating an input video data and generating the backlight dimming data in the FPGA.

According to the present disclosure, by configuring the FPGA reset circuit internally or externally of the FPGA for outputting the FPGA reset signal after the configuration signal CONF-DONE is converted into the high logic voltage, it is possible to initialize the FPGA of the liquid crystal display device in stable.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Advantages and features of the present disclosure and a method of achieving the advantages and the features will be apparent by referring to embodiments described below in detail in connection with the accompanying drawings. Hereinafter, referring to drawings, some preferred embodiments of the present disclosure are explained in detail. However, the present disclosure is not restricted by these embodiments but can be applied to various changes or modifications without changing the technical spirit. In the following embodiments, the names of the elements are selected by considering the easiness for explanation so that they may be different from actual names.

When classifying by the liquid crystal material mode, the LCD according to the present disclosure can be categorized in TN (Twisted Nematic) mode, VA (Vertical Alignment) mode, IPS (In Plane Switching) mode, FFS (Fringe Field Switching) mode and so on. When classifying by the characteristics of transmittance vs voltage, it can be categorized in the NW (Normally White) mode and the NB (Normally Black) mode. In addition, the LCD according to the present disclosure can be any type of LCD device such as the transmissive type LCD, the semi-transmissive type LCD, and the reflective type LCD.

Figure 1:
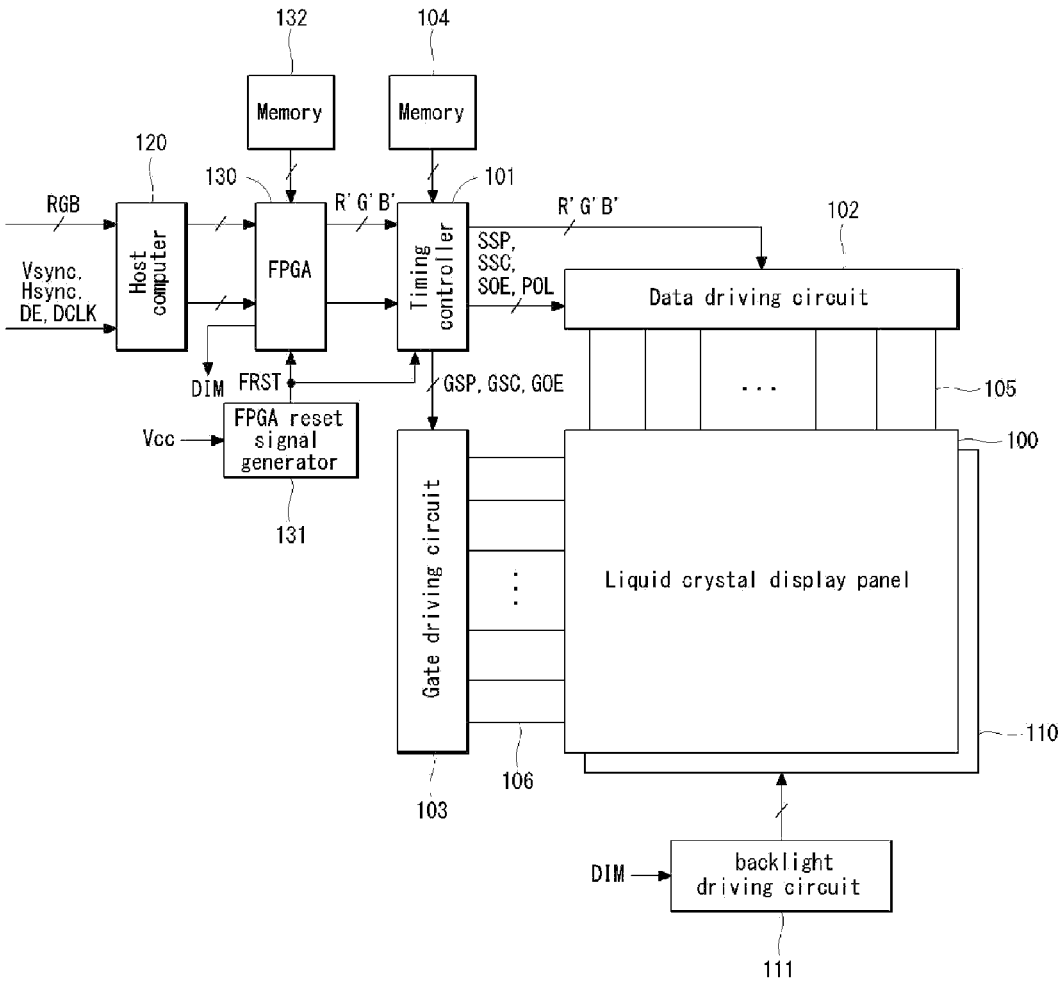
FIG. 1 is a block diagram illustrating a liquid crystal display device according to the first preferred embodiment of the present disclosure.

Referring to FIG. 1, the LCD according to a preferred embodiment of the present disclosure comprises a liquid crystal display panel 100, a back light unit 110, a backlight driving circuit 111, a FPGA 130, a timing controller 101, a data driving circuit 102, a gate driving circuit 103, and a host computer 120. The liquid crystal panel 100 comprises two glass substrates joining each other and a liquid crystal layer disposed between the two glass substrates. The liquid crystal layer includes a plurality of liquid crystal cells disposed in matrix type defined by the crossing structure of the data lines 105 and the gate lines 106.

On the lower glass substrate of the liquid crystal display panel 100, a pixel array is formed. The pixel array includes a plurality of data lines 105, a plurality of gate lines 105, a plurality of thin film transistors (or "TFT") and storage capacitors (Cst). The liquid crystal cells are driving by the electric field applied between a pixel electrode connected to the TFT and a common electrode. On the upper glass substrate of the liquid crystal display panel 100, black matrix, color filters and the common electrode are formed. At the each outside of the upper glass substrate and the lower glass substrate, an upper polarizer and a lower polarizer are attached, respectively. At the each inside of the upper glass substrate and the lower glass substrate, alignment layers are formed for setting the pre-tilt angle of the liquid crystal layer.

The backlight unit 110 is disposed under the LCD panel 100. The backlight unit 110 includes a plurality of light sources which can be turn on and off by the backlight driving circuit 111, for radiating the backlight to the LCD panel 100. The backlight unit 110 can be a direct type backlight unit or an edge type backlight unit. The light source of the backlight unit 110 can include at least one of HCFL (Hot Cathode Fluorescent Lamp), CCFL (Cold Cathode Fluorescent Lamp), EEFL (External Electrode Fluorescent Lamp), and LED (Light Emitting Diode).

The backlight driving circuit 111 turns on and off the light source of the backlight unit 110 with PWM (Pulse Width Modulation) method by responding to the backlight dimming data (or "DIM") which is input from the FPGA 130. The FPGA 130 comprises the gate array logic part including thousands of the logic elements which can be re-programmable by programming, the PLL for multiplying the frequency of the input clock, the data receiver, and the data transmitter. The built-in PLL of the FPGA 130 is initialized according to the FPGA reset signal FRST input from the FPGA reset signal generator 131.

When the power of the LCD is turn on, according to the power on sequence of the LCD, the logic power voltage Vcc and the configuration signal CONF_DONE are changed into high logic voltage, sequentially. After the logic power voltage Vcc is reversed from low logic voltage to the high logic voltage, and before the configuration signal CONF_DONE is reversed to the high logic voltage, the FPGA 130 downloads the gate array connection data stored in the first non-volatile memory 132. The gate array connection data includes a gate connection data for processing the algorithm compensating the pixel data, and a gate connection data for processing the backlight dimming algorithm. According to the gate array connection data, the FPGA 130 connects the logic elements in the gate array logic part to configure the various circuits for compensating algorithms of the pixel data, for processing the backlight dimming algorithm, for filtering, and so on.

Later a predetermined time interval after the logic power voltage Vcc and the configuration signal CONF_DONE are changed to the high logic voltage sequentially, the FPGA reset signal generator 131 outputs the FPGA reset signal FRST. When the FPGA reset signal FRST is entered into the FPGA 130, the FPGA 130 inputs the PLL lock reset clock into the built-in PLL to lock the frequency and the phase of the PLL output signal.

After locking the PLL output frequency and phase, FPGA 130 conducts the sampling of the digital video data R, G, and B received from the host computer 120 via an interface such as LVDS (Low Voltage Differential Signaling) interface or TMDS (Transition Minimized Differential Signaling) interface. The FPGA 130 modulates the digital video data R, G, and B according to the algorithm. And then the FPGA 130 calculates a representative value of the input video data according to the global and local dimming algorithms. According to the representative value, the FPGA 130 selects dimming data (DIM) for controlling the backlight brightness and outputs the selected dimming data to the backlight driving circuit 111.

The timing controller 101 may be one of the application specific IC, ASIC. The timing controller 101 sends the modulated data R', G', and B' by the FPGA 130 to the data driving circuit 102 via the min LVDS interface. The timing controller 101 receives the timing signals such as the vertical synchronization signal (Vsync), the horizontal synchronizing signal (Hsync), the data enable signal (DE), the dot clock signal (DCLK) and so on from the FPGA 130. The timing controller 101 generates the timing control signals for controlling the operating timings of the data driving circuit 102 and the gate driving circuit 103 based on the timing signals received from the FPGA 130, referring to the timing data stored in the second non-volatile memory 104. The timing control signals includes a gate timing control signal for controlling the operating time of the gate driving circuit 103, and a data timing control signal for controlling the operating timing of the data driving circuit 102 and the polarity of the data voltage. The timing controller 101 can drive the LCD panel 100 with the frame frequency of (60×i) Hz by multiplying the factor i (i=integer number equal to and larger than 2) to the frame frequency of 60 Hz.

The gate timing control signal includes the gate start pulse (GSP), the gate shift clock (GSC), and the gate output enable signal (GOE). The gate start pulse (GSP) is applied to the gate drive IC (or "integrated circuit") generating the first gate pulse to control the shift start timing of the gate drive IC. The gate shift clock (GSC), as the clock signal input to the gate ICs commonly, is the clock signal for shifting the gate start pulse (GSP). The gate output enable signal (GOE) controls the output timings of the gate driving ICs.

The data timing control signal includes the source start pulse (SSP), the source sampling clock (SSC), the polarity control signal (POL), and the source output enable signal (SOE). The source start pulse (SSP) is applied to the source drive IC which will be sampling the first pixel data among the source drive ICs of the data driving circuit 102 to control the shift start timing. The source sampling clock (SSC) is the clock signal for controlling the data sampling timing in the data driving circuit 102 based on rising or falling edge. The polarity control signal (POL) controls the polarity of the data voltage output from the source drive ICs of the data driving circuit 102. If the digital video data to be input into the data driving circuit 102 is sent as being complied with the mini LVDS (Low Voltage Differential Signaling) interface specification, the source start pulse (SSP) and the source sampling clock (SSC) may not be used.

The first and the second non-volatile memories 132 and 104 may be the updatable read-only memory (ROM) such as EEPROM (Electrically Erasable Programmable Read-Only Memory).

The data driving circuit 102 comprises one or more source drive ICs. Each source drive IC includes the shift register, the latch, the digital-analog converter, and the output buffer. The source drive ICs latch the digital video data R', G', and B' under the controlling of the timing controller 101. The source drive ICs changes the digital video data R', G', and B' convert into both an analog positive data voltage using a positive gamma compensation voltage and an analog negative data voltage using a negative gamma compensation voltage. Each of the source drive IC is connected to the data line of the LCD panel 100 by the COG (Chip On Glass) process or the TAB (Tape Automated Bonding) process.

The gate driving circuit 103 comprises one or more gate drive ICs. Each gate drive IC includes the shift register, the level shifter, and the output buffer. The gate drive ICs supply the gate pulse (or scan pulse) to the gate lines 106 sequentially by responding to the gate timing control signals. The gate drive ICs of the gate driving circuit 103 can be connected to the gate lines of the lower glass substrate of the LCD panel 100 by the TAB process or can be directly formed on lower glass substrate of the LCD panel 100 by the GIP (Gate In Panel) process.

Figure 2:
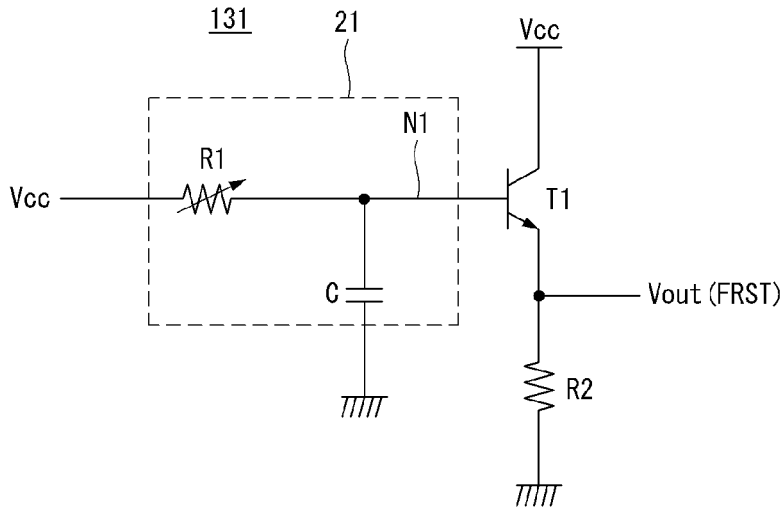
FIG. 2 is a circuit diagram illustrating one example of the reset part of the FPGA shown in FIG. 1.

The host computer 120 sends the digital video data R, G, and B, and the timing signals (Vsync, Hsync, DE, and CLK) to the FPGA 130 via the interface such as LVDS interface or TMDS interface. FIG. 2 is a circuit diagram illustrating one example of the FPGA reset signal generator 131 according to the present disclosure.

Referring to FIG. 2, the FPGA reset signal generator 131 comprises a delay part 21, and a transistor T1. The delay part 21 includes a variable resistor R1 and a capacitor C. The variable resistor R1 in connected between the input terminal of the logic power voltage and the gate electrode of the transistor T1. The capacitor C in connected between the first node N1 disposed between the variable resistor R1 and the gate electrode of the transistor T1, and the ground voltage GND. The delay part 21 delays the logic power voltage Vcc with the RC calculated from the variable resistor R1 and the capacitor C, to increase the gate voltage of the transistor T1.

When the gate voltage at the first node N1 is over the thresh voltage of the transistor T1, the transistor T1 is turn on and outputs the logic power voltage Vcc so that the FPGA reset signal FRST is generated. The gate electrode of the transistor T1 is connected to the first node N1, and the draining electrode is connected to the input terminal of the logic power voltage. The source electrode of the transistor T1 is connected to the output terminal Vout and the ground voltage GND via the pull down resistor R2.

Figure 3:
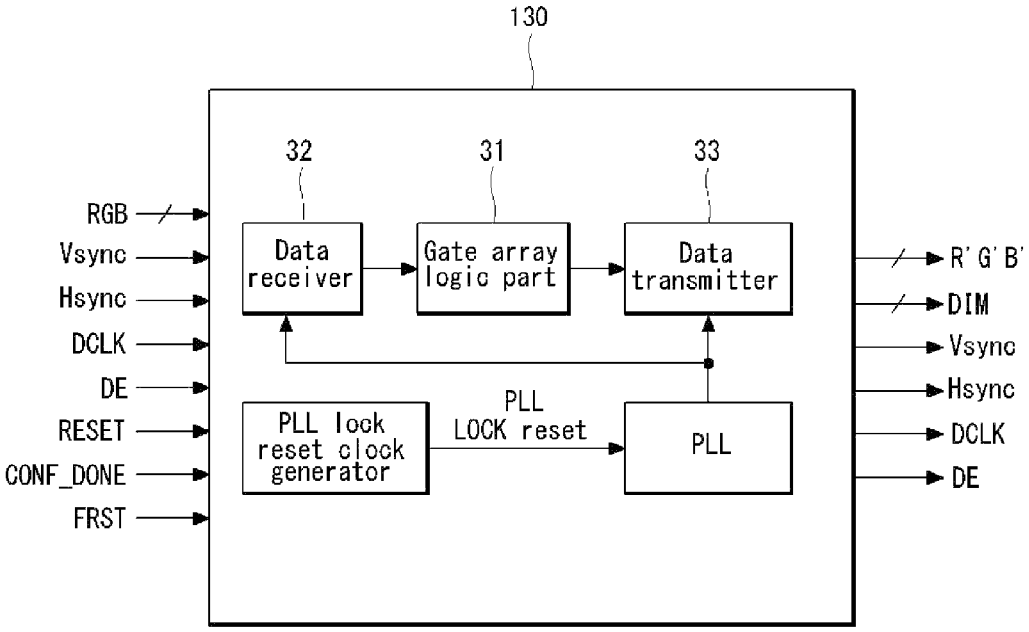
FIG. 3 is a block diagram illustrating an internal structure of the FPGA shown in FIG. 1.

FIG. 3 is a block diagram illustrating an internal structure of the FPGA 130. Referring to FIG. 3, the FPGA 130 comprises the data receiver 32, the gate array logic part 31, the data transmitter 33, the PLL lock reset clock generator 34, and the PLL 35.

The PLL lock reset clock generator 34 supplies the PLL lock reset clock to the PLL 35 by responding to the FPGA reset signal FRST. According to the PLL lock reset clock, the PLL 35 fixes the output frequency and phase, and then generates the internal clock with the multiplied frequency. The clock signal output from the PLL 35 is supplied to the data receiver 32 and the data transmitter 33.

The data receiver 32 conducts the sampling of the input video data according to the output clock of the PLL 35, and then sends the sampling results to the gate array logic part 31. The gate array logic part 31, according to the compensating algorithm, modulates the input data from the data receiver 32, and then sends the modulated data R', G', and B' to the timing controller 101 via the data transmitter 33. The gate array logic part 31, according to the frame representative value of the input video data, selects the backlight dimming data (DIM) and then sends it to the backlight driving circuit 111. The data receiver 32 may be the TMDS receiver or the LVDS receiver. The data transmitter 33 may be the TMDS transmitter or the LVDS transmitter.

Figure 4:
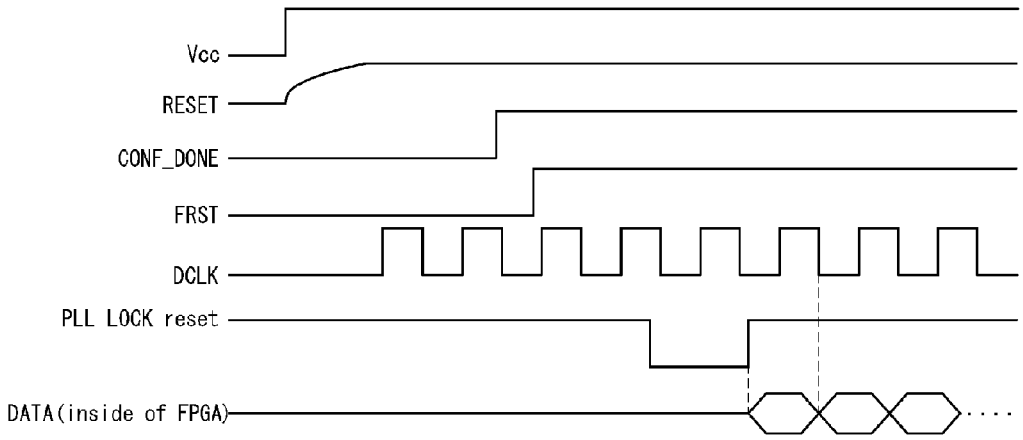
FIG. 4 is a waveform diagram illustrating the initialization procedure of the FPGA according to the present disclosure.

FIG. 4 is a waveform diagram illustrating the initialization procedure of the FPGA 130. Referring to FIG. 4, when the power of the LCD is turn on, the logic power voltage Vcc is output from a power IC (not shown) according to the power on sequence. Later a predetermined time interval after the logic power voltage Vcc is reversed to the high logic voltage, the reset signal RESET is increased to the high logic voltage by the RC delaying of the logic power voltage Vcc, and then the configuration signal CONF_DONE is reversed to the light logic voltage.

When the power of the LCD is turn on, according to the power on sequence of the LCD, the logic power voltage Vcc and the configuration signal CONF_DONE are changed into high logic voltage, sequentially. After the logic power voltage Vcc is reversed from low logic voltage to the high logic voltage, and before the configuration signal CONF_DONE is reversed to the high logic voltage, the FPGA 130 downloads the gate array connection data stored in the first non-volatile memory 132.

After that, the FPGA reset signal generator 131 delays the logic power voltage Vcc to reverse the FPGA reset signal FRST to the high logic voltage. According to the FPGA reset signal FRST, the FPGA 130 fixes the output frequency and phase of the PLL 35, starts the sampling of the input video data, modulates the sampled data, and then outputs the dimming data.

Figure 5:
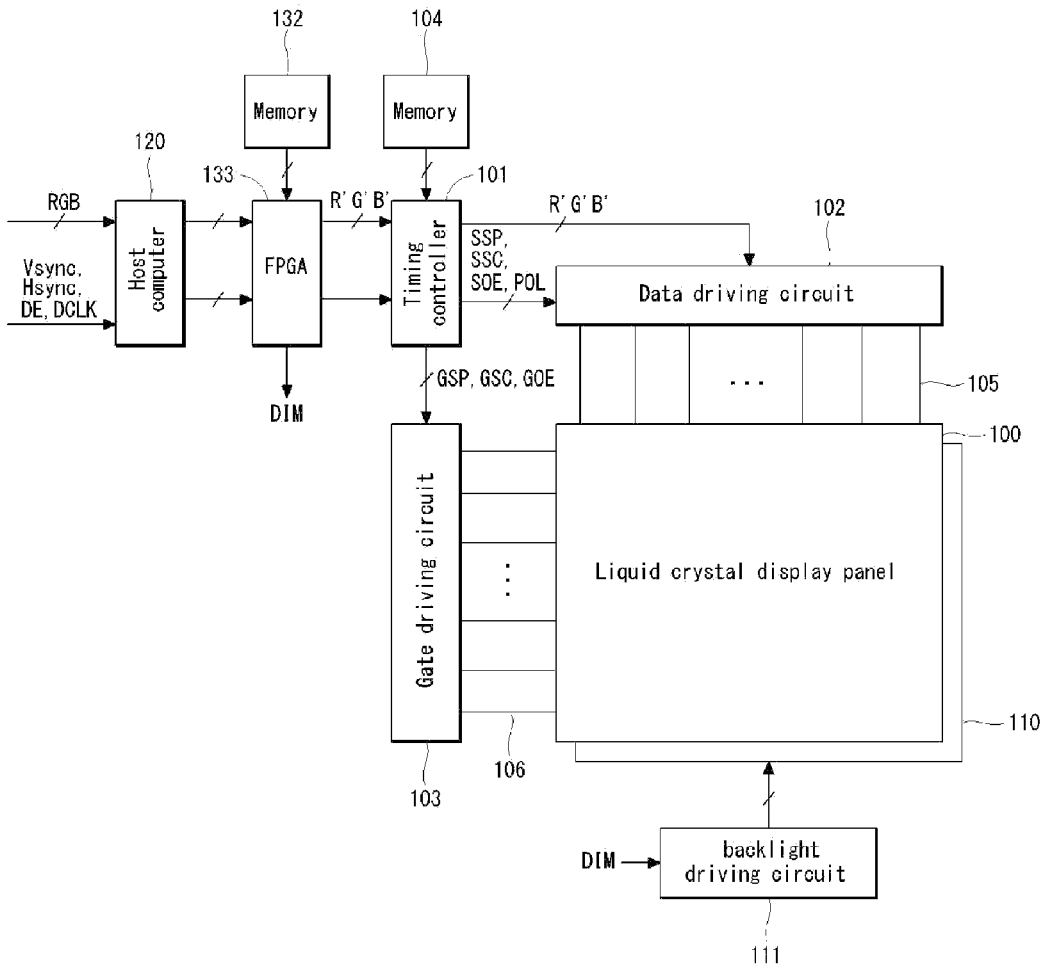
FIG. 5 is a block diagram illustrating a liquid crystal display device according to the second preferred embodiment of the present disclosure.

FIG. 5 is a block diagram illustrating a liquid crystal display device according to the second preferred embodiment of the present disclosure. Referring to FIG. 5, the LCD according to the second embodiment of the present disclosure comprises a liquid crystal display panel 100, a backlight unit 110, a backlight driving circuit 111, a FPGA 133, a timing controller 101, a data driving circuit 102, a gate driving circuit 103, and a host computer 120. As the liquid crystal display panel 100, the backlight unit 110, the backlight driving circuit 111, the data driving circuit 102, the gate driving circuit 103, and the host computer 120 are substantially same with those described in the first embodiment, the detail explanations are not mentioned.

The FPGA 133 comprises the gate array logic part including thousands of the logic elements which can be re-programmable by programming, the PLL for multiplying the frequency of the input clock, the data receiver, and the data transmitter. The built-in PLL of the FPGA 133 is initialized by the FPGA reset signal FRST internally generated later predetermined time interval after the power of the LCD is turn on.

After the logic power voltage Vcc is reversed from low logic voltage to the high logic voltage, and before the configuration signal CONF_DONE is reversed to the high logic voltage, the FPGA 133 downloads the gate array connection data stored in the first non-volatile memory 134. The gate array connection data includes a gate connection data for configuring the FPGA reset signal generator, a gate connection data for processing the algorithm compensating the pixel data, and a gate connection data for processing the backlight dimming algorithm. According to the gate array connection data, the FPGA 133 connects the logic elements in the gate array logic part to configure the various circuits for internal reset part, for compensating algorithms of the pixel data, for processing the backlight dimming algorithm, for filtering, and so on.

After locking the PLL output frequency and phase, FPGA 133 conducts the sampling of the digital video data R, G, and B received from the host computer 120 via an interface such as LVDS interface or TMDS interface. The FPGA 133 modulates the digital video data R, G, and B according to the algorithm. And then the FPGA 133 calculates a representative value of the input video data according to the global and local dimming algorithms. According to the representative value, the FPGA 133 selects dimming data (DIM) for controlling the backlight brightness and outputs the selected dimming data to the backlight driving circuit 111.

Figure 6:
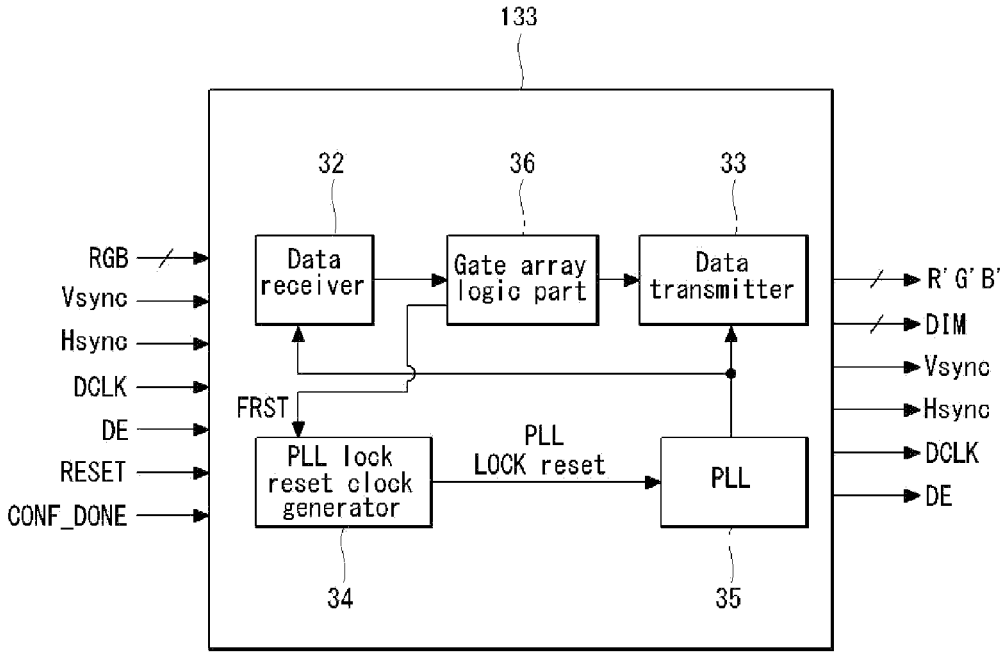
FIG. 6 is a circuit diagram illustrating one example of the reset part of the FPGA shown in FIG. 5.
Figure 7:
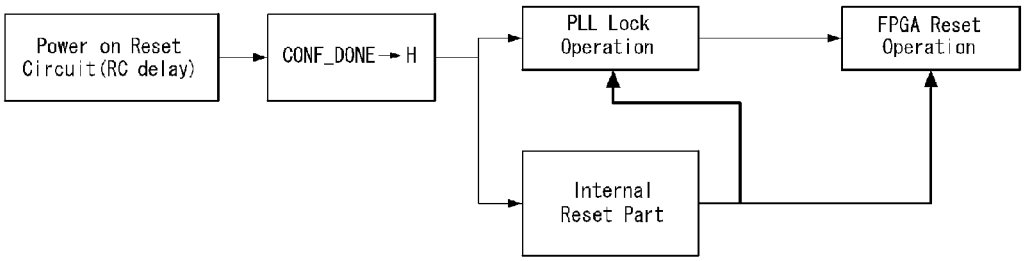
FIG. 7 is a diagram illustrating the internal reset procedure of the PLL according to the present disclosure.

FIG. 6 is a circuit diagram illustrating one example of the reset part of the FPGA 133. FIG. 7 is a diagram illustrating the initialization procedure of the FPGA 133 according to the second preferred embodiment of the present disclosure. Referring to FIGS. 6 and 7, the FPGA 133 comprises the data receiver 32, the gate array logic part 36, the data transmitter 33, the PLL lock reset clock generator 34, and the PLL 35.

When the power of the LCD is turn on, according to the power on sequence of the LCD, the logic power voltage Vcc, the reset signal RESET, and the configuration signal CONF_DONE are sequentially changed to the high logic voltage. The reset signal RESET is output from the RC delay circuit configured to delay the logic power voltage Vcc.

The internal reset generator of the gate array logic part 36 counts the vertical synchronization signal Vsync, and then outputs the FPGA reset signal FRST when a predetermined time interval is past after the power of the LCD is turn on. For example, the gate array logic part 36 counts the vertical synchronizing signal Vsync received just after the power of the LCD is turn on, and then outputs the FPGA reset signal FRST when Nth (N is the integer number equal to or larger than 2) frame is starting or ending. Here, if N is 3 and the frame frequency is 120 Hz, the FPGA reset signal FRST may be generated at 25 ms later after the power of LCD is turn on. Alternatively, the internal reset generator of the gate array logic part 36 can output the FPGA reset signal FRST if the frequency and phase of the PLL 35 output signal is abnormal by monitoring the output of the PLL 35.

The PLL lock reset clock generator 34 supplies the PLL lock reset clock to the PLL 35 by responding to the FPGA reset signal FRST received from the gate array logic part 36. According to the PLL lock reset clock, the PLL 35 fixes the output frequency and phase, and then generates the internal clock with the multiplied frequency. The clock signal output from the PLL 35 is supplied to the data receiver 32 and the data transmitter 33.

The gate array logic part 36, according to the data compensating algorithm, modulates the input data from the data receiver 32, and then sends the modulated data R', G', and B' to the timing controller 101 via the data transmitter 33. The gate array logic part 36, according to the frame representative value of the input video data, selects the backlight dimming data (DIM) and then sends it to the backlight driving circuit 111.

If the panel characteristics of the LCD panel 100 or the driving method are changed or updated, the existing algorithms should be modified or new algorithms should be added into the FPGA 130 and 133. For updating the algorithms, a ROM writer is connected to the first non-volatile memory 132 and 134 via an user interface and then the existing gate connection data for the existing algorithms stored in the first non-volatile memory 132 and 134 can be modified or a new gate array connection data for a new algorithms may be added to the first non-volatile memory 132 and 134. Alternatively, by setting the host computer 120 and the FPGA 130 and 133 as the master and the slave devices, respectively, and by using the host computer 120, the circuit configuration of the gate array logic part 31 and 36 can be modified.

While the embodiment of the present invention has been described in detail with reference to the drawings, it will be understood by those skilled in the art that the invention can be implemented in other specific forms without changing the technical spirit or essential features of the invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

What is claimed is:

1. A liquid crystal display device comprising:

a liquid crystal display panel including a plurality of data lines and a plurality of gate lines crossing each other;

a backlight unit configured to radiate backlight to the liquid crystal display panel;

a backlight driving circuit configured to turn on and off light sources of the backlight unit according to a backlight dimming data;

a data driving circuit configured to convert digital video data into positive and negative data voltages and to supply the positive and the negative data voltages to the plurality of data line;

a gate driving circuit configured to supply a gate pulse to the plurality of gate line sequentially;

a field programmable gate array (FPGA) configured to set circuit configurations of a built-in gate array logic part according to a gate array connection data downloaded from a non-volatile memory in order to modulate an input video data and to generate the backlight dimming data; and a timing controller configured to control operating timings of the data driving circuit and the gate driving circuit, wherein the FPGA includes:

a built-in phase-locked loop (PLL) configured to generate an internal clock and lock a frequency and a phase of the internal clock output by responding to a PLL lock reset signal;

a PLL lock reset clock generator configured to supply the PLL lock reset signal to the built-in PLL by responding to a FPGA reset signal;

a data receiver configured to sample the input video data according to the internal clock from the built-in PLL and supply the received input video data to the gate array logic part; and a data transmitter configured to send a modulated data by the gate array logic part to the timing controller, wherein the field programmable gate array downloads the gate array connection data from the non-volatile memory during a time interval which is defined from when a logic power voltage generated after a power of the liquid crystal display device is turn on is converted into a high logic voltage to when a configuration signal is reversed to the high logic voltage, and wherein the gate array logic part configures an internal reset circuit to output the FPGA reset signal according to the gate array connection data.

2. The device according to the claim 1, wherein the field programmable gate array further includes an external FPGA reset signal generator configured to output the FPGA reset signal after the configuration signal is reversed to the high logic voltage by delaying the logic power voltage.

3. The device according to the claim 1, wherein the internal reset circuit outputs the FPGA reset signal at Nth (N is an integer number equal to or larger than 2) frame period by counting vertical synchronization signals after the power of the liquid crystal display device is turn on.

4. A method for initializing a field programmable gate array (FPGA) of a liquid crystal display device comprising a liquid crystal display panel including a plurality of data lines and a plurality of gate lines crossing each other, a backlight unit radiating backlight to the liquid crystal display panel, a backlight driving circuit turning on and off light sources of the backlight unit according to a backlight dimming data, a data driving circuit converting digital video data into positive and negative data voltages and supplying the positive and the negative data voltages to the plurality of data line, and a gate driving circuit supplying a gate pulse to the plurality of gate line sequentially, comprising:

supplying a gate array connection data stored in a non-volatile memory to the FPGA during from when a logic power voltage generated after a power of the liquid crystal display device is turn on is converted into a high logic voltage to when a configuration signal is reversed to the high logic voltage;

configuring a circuit in a gate array logic part of the FPGA according to the gate array connection data;

generating a FPGA reset signal after the configuration signal is reversed to the high logic voltage;

locking a frequency and a phase of an internal clock output from a build-in phase-locked loop (PLL) of the FPGA using the FPGA reset signal; and modulating an input video data and generating the backlight dimming data in the FPGA, wherein the FPGA reset signal is output from an internal reset circuit configured in the gate array logic part according to the gate array connection data.

5. The method according to the claim 4, wherein the FPGA reset signal is generated according to a delay of the logic power voltage delayed by a delay circuit installed outside of the FPGA.

* * * * *